US006735413B2

(12) United States Patent
Yuza et al.

(10) Patent No.: US 6,735,413 B2
(45) Date of Patent: May 11, 2004

(54) SHEET OPERATIVE MEMBER, AND SHEET CONVEYING APPARATUS AND IMAGE PROCESSING APPARATUS USING THE SHEET OPERATIVE MEMBER

(75) Inventors: Akira Yuza, Shizuoka-ken (JP); Kenichi Kobayashi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/409,051

(22) Filed: Apr. 9, 2003

(65) Prior Publication Data

US 2003/0193134 A1 Oct. 16, 2003

(30) Foreign Application Priority Data

Apr. 11, 2002 (JP) ..... 2002-108843

(51) Int. Cl.[7] ..... G03G 15/00
(52) U.S. Cl. ..... 399/361; 399/107
(58) Field of Search ..... 271/9.09, 240; 399/107, 115, 121, 122, 313, 333, 361

(56) References Cited

U.S. PATENT DOCUMENTS

| | | | | |
|---|---|---|---|---|
| 4,905,984 A | * | 3/1990 | Haigh | 399/361 |
| 5,019,840 A | * | 5/1991 | Watanabe et al. | 399/361 |
| 5,390,016 A | | 2/1995 | Hoshi et al. | |
| 5,404,214 A | | 4/1995 | Yoshimoto et al. | |
| 5,493,379 A | | 2/1996 | Kuroda et al. | |
| 5,621,451 A | | 4/1997 | Sugiura et al. | 347/112 |
| 5,752,149 A | | 5/1998 | Yuza et al. | 399/329 |
| 5,927,702 A | | 7/1999 | Ishii et al. | 271/9.09 |
| 6,070,867 A | | 6/2000 | Tsurumi et al. | 271/114 |

* cited by examiner

*Primary Examiner*—Hoang Ngo
(74) *Attorney, Agent, or Firm*—Fitzpatrick, Cella, Harper & Scinto

(57) ABSTRACT

The present invention relates to a sheet operative member contacting a sheet and conveying with frictional force the sheet or separating the sheet, the sheet operative member comprising a plurality of protrusions on an operative surface with the sheet. Each of the protrusions includes a standing portion standing up from the operative surface and a spherical portion disposed at a distal end of the standing portion.

13 Claims, 10 Drawing Sheets

SHEET OPERATIVE MEMBER, AND SHEET CONVEYING APPARATUS AND IMAGE PROCESSING APPARATUS USING THE SHEET OPERATIVE MEMBER

BACKGROUND OF THE INVENTION

1. Field of the Invention

This invention relates to a sheet operative member such as a conveyance roller for contacting and conveying sheets by frictional force thereof, and a separation pad for separating sheets, to a sheet conveying apparatus using this member, and to an image processing apparatus such as an electrophotographic photocopier, a printer, a word processor, and a facsimile machine.

2. Description of Related Art

Image forming apparatuses such as printers and photocopiers using one of electrophotographic methods or other recording methods are widely available these days. In accordance with tendency of higher performance and longer duration of the apparatuses, improvements in feeding accuracy and durability in conveyance rollers used in the image forming apparatus are required. Separation pads used for the image forming apparatuses also require in the same manner improvements in separation accuracy and durability.

A conventional conveyance roller 100 is formed, as shown in FIG. 8, of a core metal 101 made of a metal or molded material and a cylindrical rubber portion 102 made of a rubber material such as EPDM (ethylene propylene rubber), CR rubber (chloroprene rubber), silicone rubber, or urethane rubber for contacting a recording sheet and conveying the recording sheet by frictional force. Polishing is made in arrow C or D direction shown in FIG. 8 on a cylindrical surface 102*a* of the cylindrical rubber portion 102.

A separation pad 103 shown in FIG. 9 is formed of a rubber material such as EPDM, CR rubber, silicone rubber, or urethane rubber in substantially the same manner as the conveyance roller 100 described above and is constituted of a rubber portion 104 in contact with the conveyance roller, and a holder 105 holding the rubber portion 104. Polishing is made in arrow E or F direction shown in FIG. 9 on a rubber surface 104*a* of the rubber portion 104.

The conventional conveyance roller and the conventional separation pad, however, raised the following problems.

Where the conventional conveyance roller conveys a recording sheet, paper powder generated from surfaces of the recording sheets may attach to the cylindrical surface of the conveyance roller according to an increased conveyance sheet number of the recording sheets, thereby slipping in recording sheet conveyance with lowered frictional force of the conveyance roller, and thereby raising a problem of impaired images and jamming occurrences. To extend the product duration of the apparatus body, users were required to make cleaning, or the apparatuses had a structure that the users can replace the conveyance rollers. As a result, this invited lowered usability and increased costs from additional parts in a structure that the conveyance roller is replaceable.

Where the conventional separation pad separates and conveys the recording sheets, paper powder generated from surfaces of the recording sheets may attach to the surface of the separation pad according to an increased conveyance sheet number of the recording sheets, thereby raising a problem of doubly feeding of the recording sheets due to lowered frictional force of the separation pad. Therefore, substantially the same problem is raised as in the case of the conveyance roller.

SUMMARY OF THE INVENTION

This invention is to solve the above problems. It is an object of the invention to provide a sheet operative member such as a conveyance roller or the like avoiding lowered frictional force due to paper powder attachments, realizing highly durable roller members or the like, and having an inexpensive structure of a longer duration with maintenance free and to provide a sheet conveying apparatus and an image processing apparatus using the member.

A preventative structure according to the invention to accomplish the above object is a sheet operative member contacting a sheet and conveying with frictional force the sheet or separating, including a plurality of protrusions on an operative surface with the sheet; and each of the protrusions including: a standing portion standing up from the operative surface; and a spherical portion disposed at a distal end of the standing portion.

Where a conveyance roller is structure of the sheet operative member thus structured, the sheet is conveyed with frictional force from contact with the spherical portions of the protrusions of the conveyance roller. Because the contact between the conveyance roller and the sheet is at the spherical portion at the distal end of the protrusion, paper powder or the like generated from the sheet surfaces is not attached to the spherical portions of the protrusions but deposited in an attaching manner on a circumferential surface of the conveyance roller. This realizes a conveyance roller having property of stable conveyance and high durability. The same advantages can be provided in a case where the sheet operative member is used as a separation pad.

According to the invention, where fine protrusions described above are formed to the sheet operative member, a sheet apparatus is hardly affected from paper powder or the like generated from the sheet surfaces and can enjoy a stable sheet processing performance. Therefore, where structured in use of the sheet operative member described above, the sheet apparatus such as a sheet conveying apparatus can be provided with maintenance free and inexpensive costs.

DETAILED DESCRIPTION OF THE PREFERRED EMBODIMENTS

An image forming apparatus for forming images on a sheet is exemplified as an image processing apparatus using a sheet operative member according an embodiment of the invention.

[First Embodiment]

Figure 1:
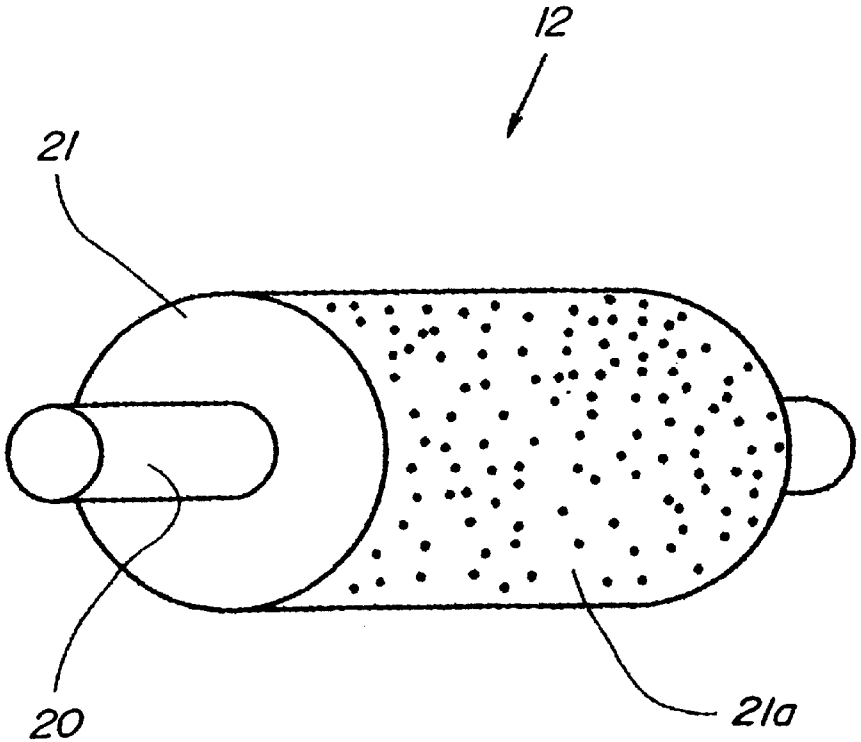
FIG. 1 is a schematic perspective view showing the whole conveyance roller.
Figure 2:
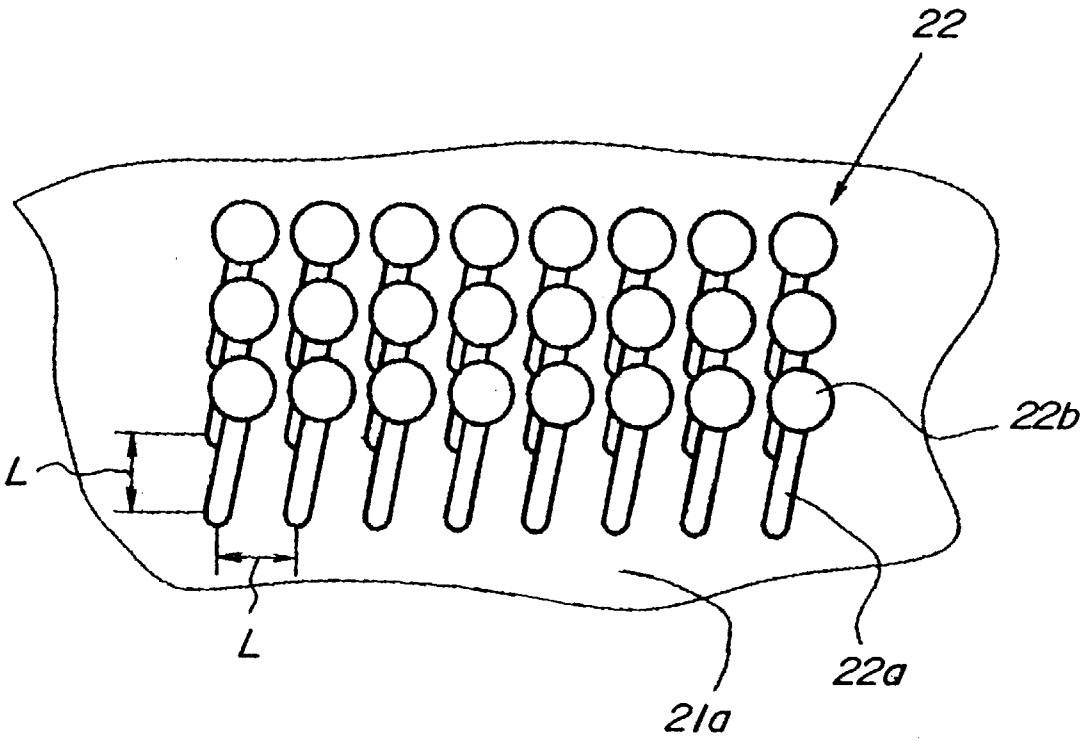
FIG. 2 is an enlarged perspective view showing a portion where fine protrusions formed on the conveyance exist.
Figure 3:
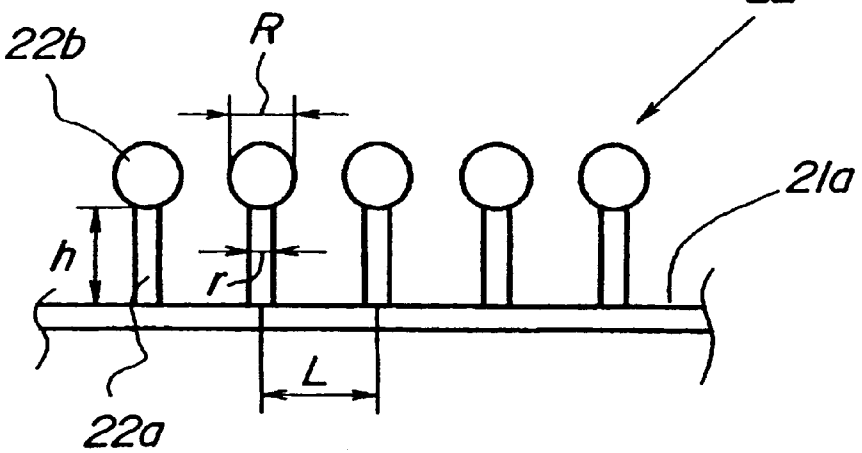
FIG. 3 is a side view showing the fine protrusions formed on the conveyance roller.
Figure 4:
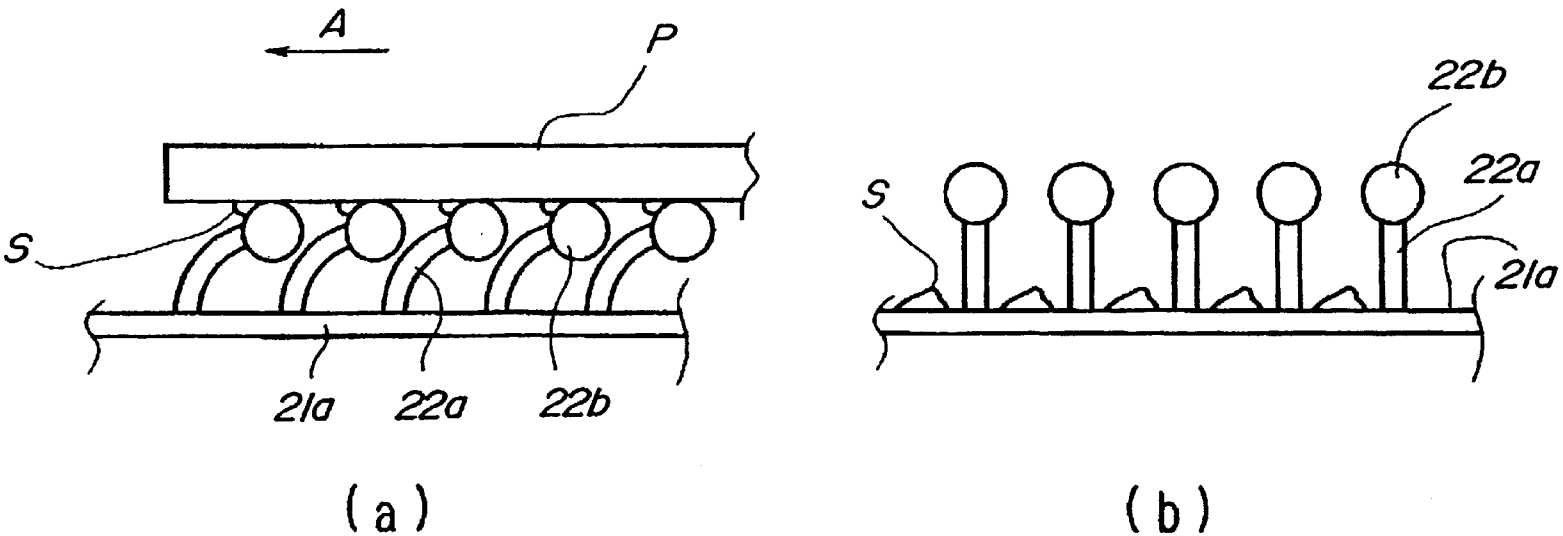
FIG. 4 is an illustration showing a contact state between the fine protrusions and the recording sheet while the conveyance roller is conveying the sheet.
Figure 5:
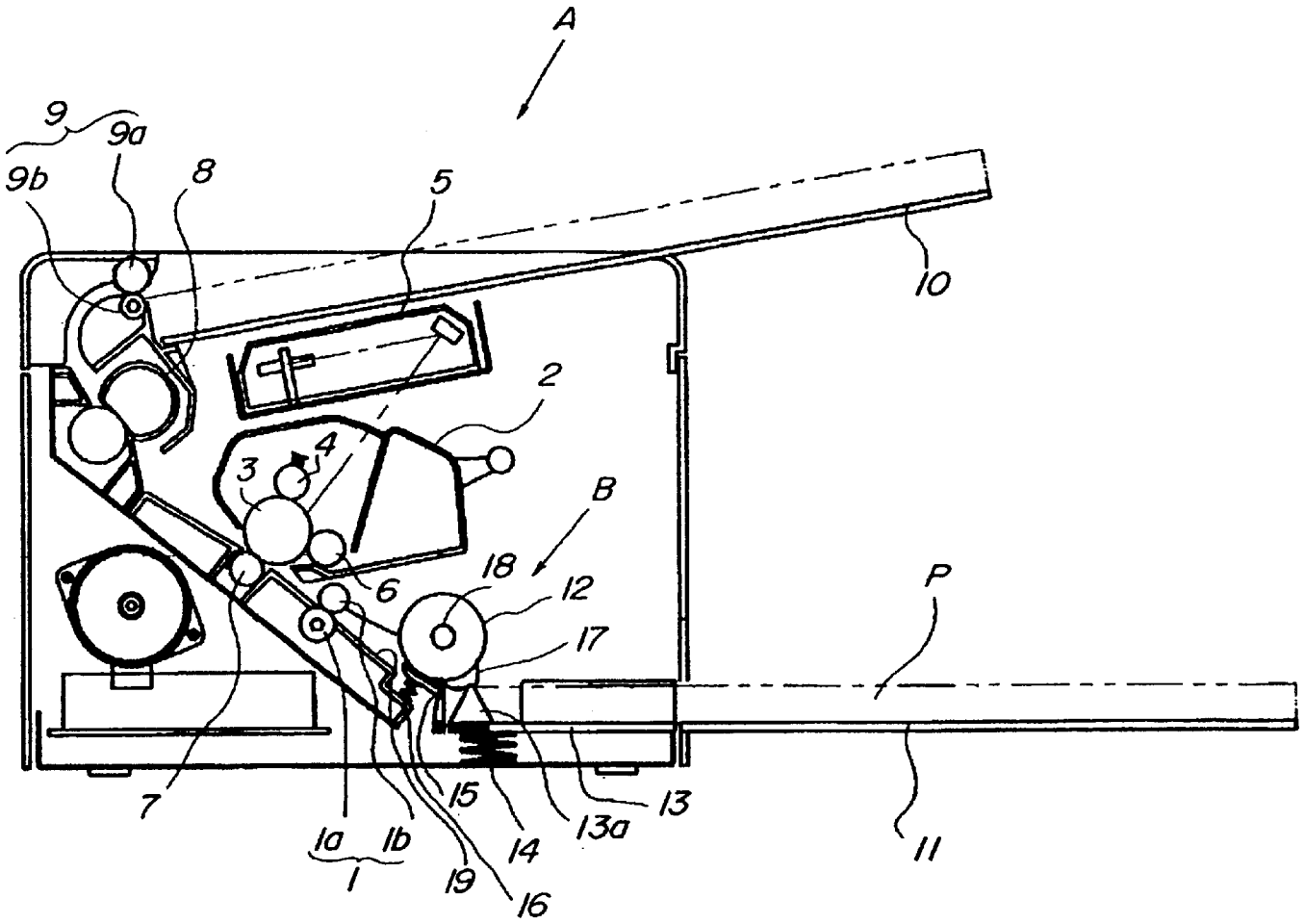
FIG. 5 is a whole schematic view showing an image processing apparatus using a sheet operative member according to the invention.

The first embodiment is an example in which the sheet operative member is used as a conveyance roller, and is described in reference to FIG. 1 to FIG. 5. It is to be noted that: FIG. 1 is a schematic perspective view showing the whole conveyance roller; FIG. 2 is an enlarged perspective view showing a portion where fine protrusions formed on the conveyance exist; FIG. 3 is a side view showing the fine protrusions formed on the conveyance roller; FIG. 4 is an illustration showing a contact state between the fine protrusions and the recording sheet while the conveyance roller is conveying the sheet; FIG. 5 is a whole schematic view showing an image processing apparatus using a sheet operative member according to the invention.

[Image Processing Apparatus]

First, the whole structure of the image forming apparatus is described in reference to FIG. 5. In FIG. 5, the image forming apparatus A is for conveying separately one by one the sheets P stacked by a sheet conveying apparatus B, and for conveying the recording sheet P to an image forming portion by a conveyance roller pair 1 made of a conveyance roller 1*a* and a conveyance roller 1*b* to recording images in an electrophotographic method. That is, a photosensitive drum 3 contained in a process cartridge 2 is rotated in synchrony with the conveyance of the recording sheet; a electrostatic latent image is formed by selective photo-radiation out of a laser scanning optical system 5 after a primary charger 4 charges the surface of the photosensitive drum 3; the latent image is developed with toner at the developing unit 6. The toner image is transferred to the recording sheet P by application of a transfer bias to a transfer roller 7 with respect to the recording sheet thus conveyed.

With the structure, the recording sheet P transferred with the toner image is heated and pressed by a fixing unit 8 to fix the toner image on the recording sheet P, and the recording sheet P thus fixed is delivered to a delivery tray 10 by a delivery roller pair 9 made of a delivery roller 9*a* and a delivery roller 9*b*.

[Sheet Conveying Apparatus]

The sheet conveying apparatus B is a feeding tray 11 for supporting the recording sheet P, a pressing plate 13 serving as a pushing means for pushing a front end portion of the recording sheet P supported by the feeding tray 11 to a conveyance roller 12, a pressing spring 14 for urging the pressing plate 13, a separation pad 15 serving as a separating means for separating one by one the recording sheets fed out by the conveyance roller 12, and a separation spring 16 for urging the separation pad 15 to the conveyance roller 12.

A cam 17 is secured to a shaft 18 of the conveyance roller 12 and urges the pressing plate 13 in opposing to the pressing spring 14 so that the recording material P does not contact with the conveyance roller 12 in an apparatus waiting state as contacting to a cam portion 13*a* of the pressing plate 13.

The conveyance roller 12 is for feeding the recording sheet P separated into one sheet by the separation pad 15 to a conveyance route 19 as being in contact with the topmost sheet surface of the plural recording sheets P supported to the feeding tray 11 as stacked.

[Sheet Operative Member]

Next, a structure of the conveyance roller 12 used in the sheet conveying apparatus B is described in reference to FIG. 1 to FIG. 4.

The conveyance roller 12 is a sheet operative member applying conveyance force to a sheet by frictional force and as shown in FIG. 1, is structured of a core portion 20 whose material is a metal or molded one, and a cylindrical rubber portion 21 formed of a rubber material whose material is made of EPDM, CR rubber, silicone rubber, urethane rubber, or the like, contacting the recording sheet P and conveying the recording sheet P by the frictional force. Fine protrusions 22 shown in FIG. 2 and FIG. 3 are formed on a cylindrical surface 21*a* (operative surface to the sheet) of the cylindrical rubber portion 21 of the conveyance roller 12.

Each of the fine protrusions 22 is formed, as shown in FIG. 2 and FIG. 3, of a standing portion 22*a* standing from the cylindrical surface 21*a* of the cylindrical rubber portion 21, and a spherical portion 22*b* in a spherical shape formed at a distal end of the standing portion 22*a*. The fine protrusions are arranged to have substantially equal interval L with the adjacent fine protrusions 22. The height of the fine protrusion 22 is formed in a range of 1 to 500 $\mu$m in consideration of the size and thickness of the recording sheet to be conveyed.

This is because, if the height is lower than 1 $\mu$m, the preventive effect of the paper powder attachments to the conveyance roller 12 and the improvement in durability is rarely obtained, and if the height is higher than 500 $\mu$m, elastic force from elastic transformation of the fine protrusions affects much more the conveyance force during the conveyance of the recording sheet P, thereby rendering difficult to maintain stable conveyance force. Therefore it is desired to set the height of the fine protrusions 22 in the above range.

It is to be noted that in this embodiment the standing portion 22*a* of the fine protrusions is in a cylindrical shape. The diameter R of the spherical portion 22*b* is structured larger than the cylindrical diameter r of the standing portion 22*a* but smaller than the length h of the standing portion 22*a*.

When the recording sheet P is conveyed with the conveyance roller 12 formed with the fine protrusions 22 with the above structure, the conveyance roller 12 rotates in arrow A direction as shown in FIG. 4(*a*), and the recording sheet P is conveyed in arrow A direction. The recording sheet P is at that time conveyed from the frictional force generated in contact with the spherical portion 22*b* of the conveyance roller 12. The fine protrusions 22 conveying the recording sheet P as in contact with the recording sheet P are in a falling down state as elastically transformed in a direction opposing to the conveyance direction (arrow A direction) of the recording sheet P as shown in FIG. 4(*a*). The recording sheet P is conveyed under this situation, but during conveyance of the recording sheet P fine dropped objects (hereinafter simply referred to as "paper powder S") such as paper powder from the surface of the recording sheet P are generated at the contact portion between the recording sheet P and the spherical portion 22*b* and are increased around the contact portion.

When the conveyance of the recording sheet P is finished, the fine protrusions 22 return to a molded state as released from the elastically transformed state as shown in FIG. 4(*b*). At that time, the paper powder S generated at the contact portion between the spherical portion 22*b* and the recording sheet P may be deposited in an attaching manner on the cylindrical surface 21*a* without attaching the spherical portion 22*b* because the spherical portion 22*b* is very small.

Since the diameter of the standing portion 22*a* is smaller than the diameter of the spherical portion 22*b*, the dropped paper powder is likely deposited at the proximal end of the standing portion 22*a* and hardly attached to the spherical portion 22*b*.

Thus, the paper powder S is not attached and deposited to the spherical portion 22*b* conveying the recording sheet P upon contacting to the recording sheet P, so that frictional force is not reduced due to paper powder attachments, and so that the conveyance roller's durability is advantageously improved.

Because the contact portion to the recording sheet P is in a spherical shape, the contact area to the recording sheet is constant, and the stable conveyance property can be maintained.

Furthermore, because the fine protrusions 22 are made of the cylindrical standing portion 22*a* and the spherical portion 22*b* in a spherical shape, no fabrication is required in consideration of the directionality with respect to the recording sheet P, and it is excellent in fine fabrication of the surface of the conveyance roller.

Since the plural fine protrusions 22 are arranged with substantially the same intervals, a uniform sheet conveyance force is provided over the entire roller surface.

It is to be noted that in this embodiment the sheet operative member is described as a conveyance roller 12, but this conveyance roller 12 can obtain substantially the same advantages where structured in the same way for others such as the conveyance roller 1*a*, the transfer roller 7, and the delivery roller 9*a*. Substantially the same advantages can be obtained where structured in the same way as that in this embodiment for the roller for feeding sheets to the image forming section even where the cross sectional shape is in a letter D shape.

[Second Embodiment]

Figure 6:
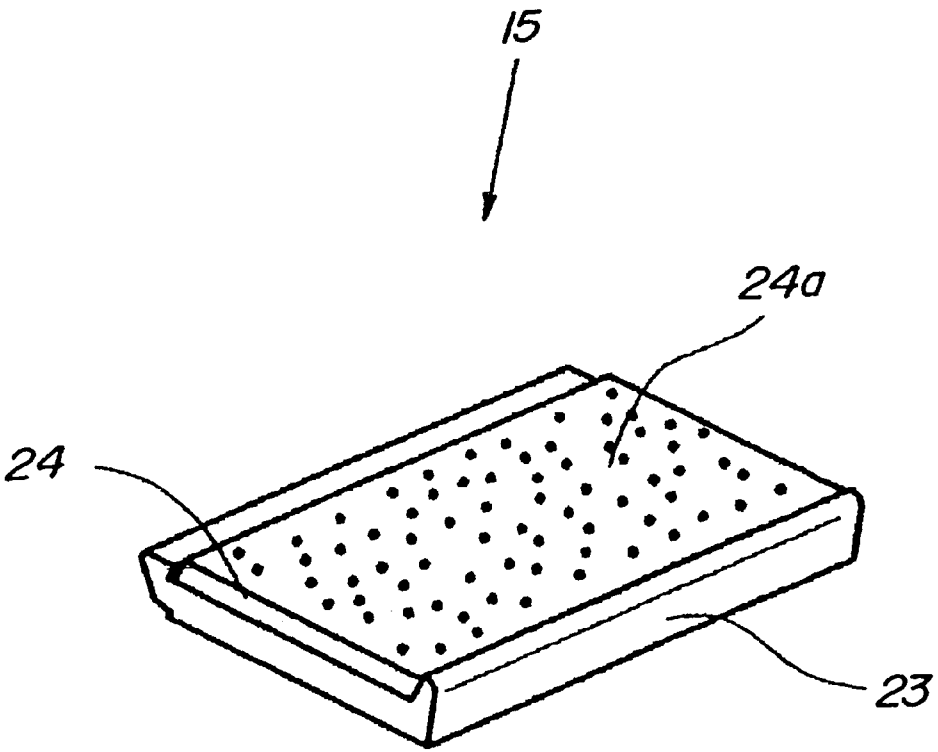
FIG. 6 is a schematic perspective view showing the entire structure of a separation pad.
Figure 7:
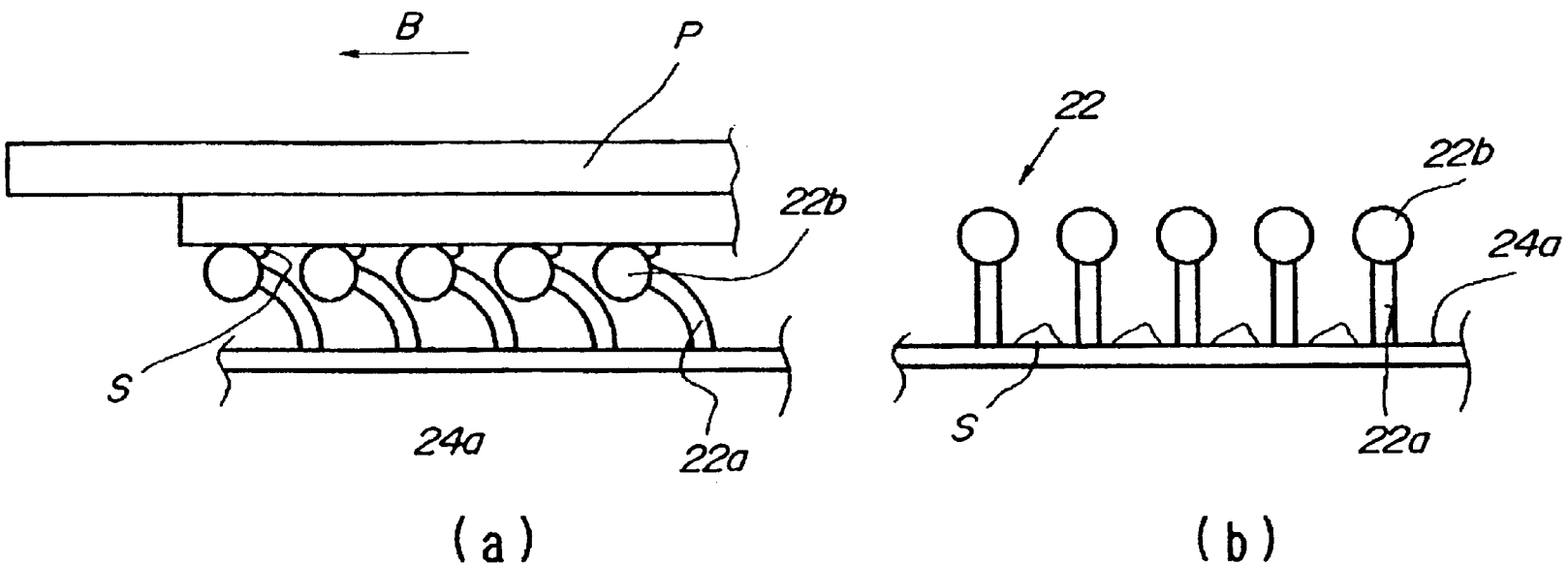
FIG. 7 is an illustration showing a contact state between the fine protrusions and the recording sheet while the separation pad is in a sheet separation state.
Figure 8:
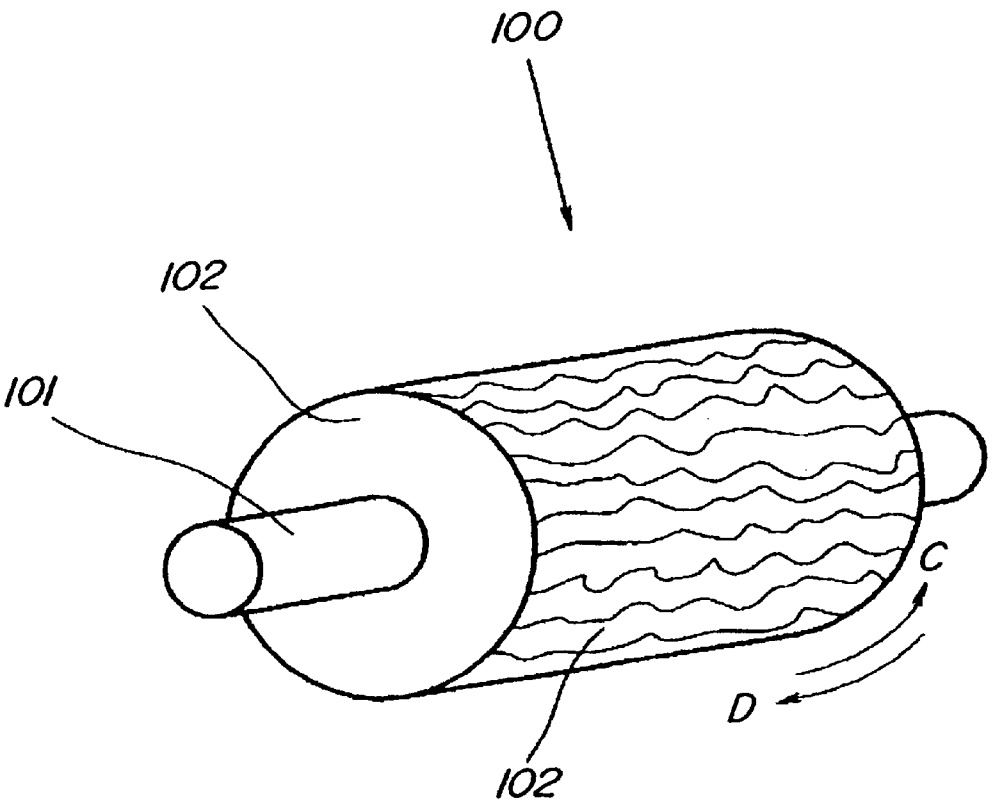
FIG. 8 is a schematic perspective view showing a conventional conveyance roller.
Figure 9:
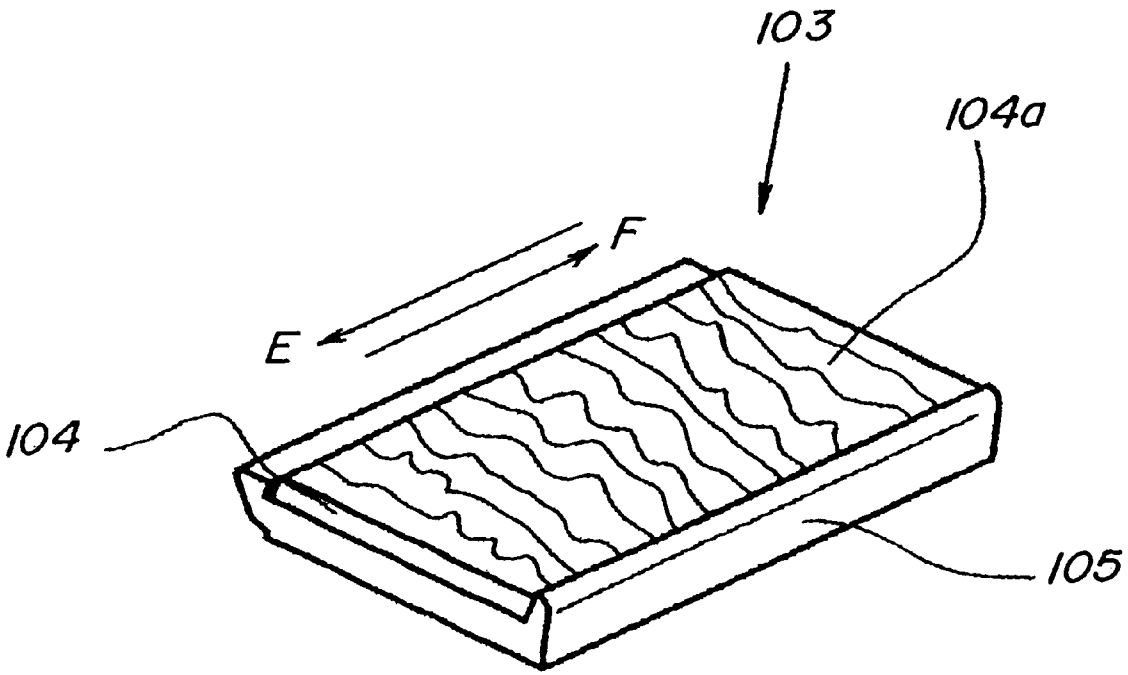
FIG. 9 is a schematic perspective view showing a conventional separation pad.

In the above first embodiment, exemplified is the fine protrusions 22 formed on the conveyance roller 12. Now, as a second embodiment, referring to FIG. 6 and FIG. 7, an example in which fine protrusions 22 are formed at a separation pad 15 as a sheet operative member is described. It is to be noted that: FIG. 6 is a schematic perspective view showing the entire structure of a separation pad; FIG. 7 is an illustration showing a contact state between the fine protrusions and the recording sheet while the separation pad is in a sheet separation state.

The separation pad 15 is, as shown in FIG. 6, constituted of a holder portion 23 whose material is metal or molded one, and a rubber material 24*b* whose material is a rubber material such as EPDM, silicone rubber, and urethane rubber for contacting with the recording sheet P and separating the recording sheet P by frictional force. Fine protrusions 22 substantially the same as the fine protrusions 22 formed on the conveyance roller 12 of the first embodiment are formed on a surface 24*a* of the rubber portion 24 of the separation pad 15. The shape of the fine protrusion 22 is substantially the same as that in the first embodiment shown in FIG. 2, FIG. 3.

Where the recording sheet P is separated with the above separation pad, as shown in FIG. 7(*a*), the recording sheets P are separated to one sheet by frictional force generated upon contact to the spherical portion 22*b* of the separation pad 15 as conveyed by the conveyance roller 12. The fine protrusions 22 contacting to the recording sheet P are, as shown in FIG. 7(*a*), in a falling down state in which the standing portions 22*a* are elastically transformed in a conveyance direction (arrow B direction) of the recording sheet P. Under this state, the recording sheet P is separated and conveyed, but during conveyance of the recording sheet P paper powder from the surface of the recording sheet P are generated at the contact portion between the recording sheet P and the spherical portion 22*b* and are increased around the contact portion.

When the separation conveyance of the recording sheet P is finished, the fine protrusions 22 return to a molded state as released from the elastically transformed state as shown in FIG. 7(*b*). At that time, the paper powder S generated at the contact portion between the spherical portion 22*b* and the recording sheet P may be deposited in an attaching manner on the cylindrical surface 21*a* without attaching the spherical portion 22*b* because the spherical portion 22*b* is very small.

Thus, where the separation pad is formed with fine protrusions 22, the apparatus is hardly affected from the paper powder in substantially the same way as in the first embodiment, and the separation ability can be maintained for a long time.

[Other Embodiments]

Although in the above embodiments exemplified is the standing portion 22*a* of the fine protrusion 22 in a cylindrical shape, the shape of the standing portion 22*a* is not limited to the cylindrical shape but can be in a cone shape, polygonal pyramid shape, or polygonal rectangular pillar shape.

Figure 10:
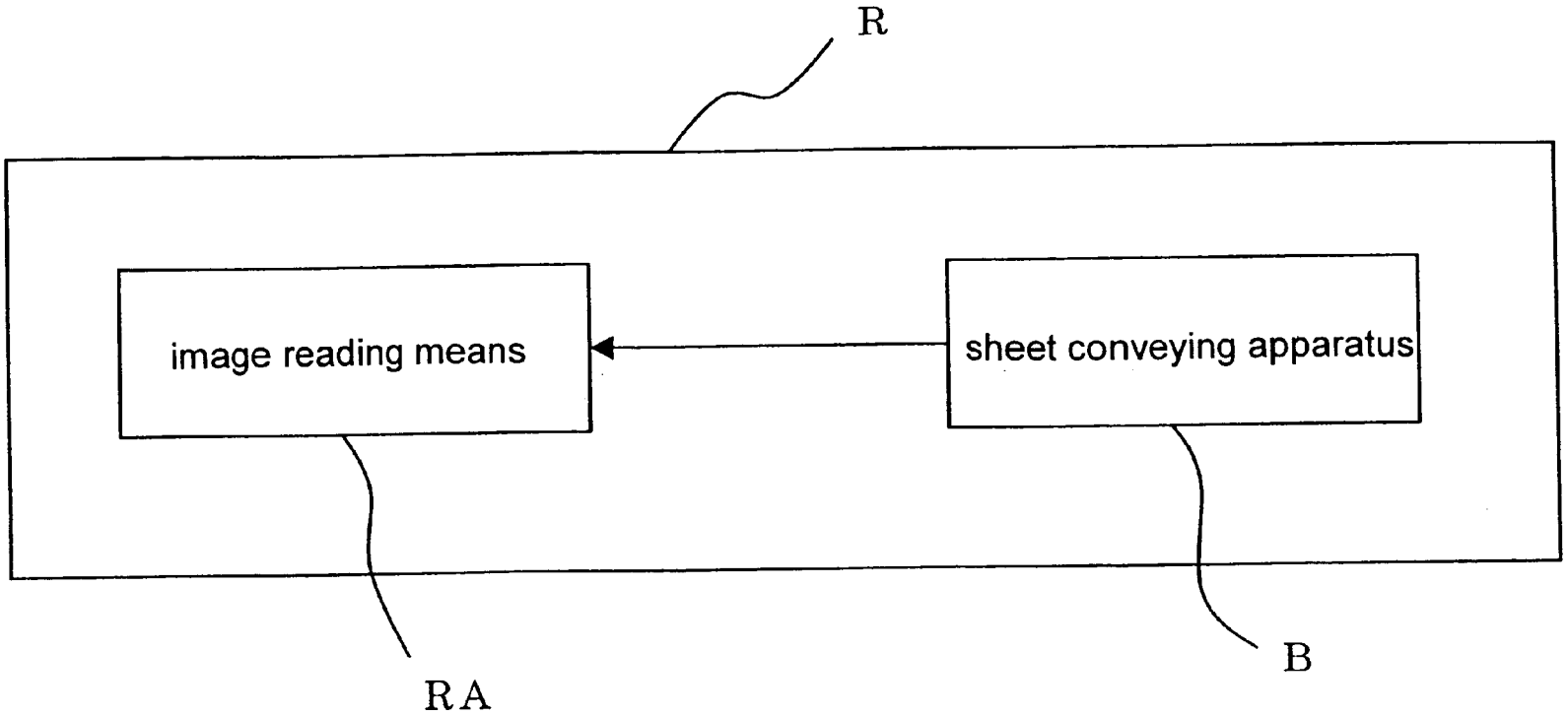
FIG. 10 is an illustration showing an image reading apparatus using a sheet operative member according to the invention.

Although in the above embodiments exemplified is an image forming apparatus in which a sheet is conveyed and images are recorded on the sheet as an image processing apparatus, the invention can be used suitably to an image reading apparatus in which a sheet conveying apparatus B separately conveys the plural original document sheets one by one and in which the images on the original document are read by an image reading means RA, as shown in FIG. 10.

What is claimed is:

1. A sheet operative member contacting a sheet and conveying with frictional force the sheet or separating the sheet, the sheet operative member comprising:

a plurality of protrusions on an operative surface with the sheet; and each of the protrusions including:

a standing portion standing up from the operative surface; and a spherical portion disposed at a distal end of the standing portion.

2. The sheet operative member according to claim 1, wherein the spherical portion has a diameter larger than the diameter of the standing portion.

3. The sheet operative member according to claim 1, wherein the plurality of the protrusions are arranged with substantially the same interval with one another.

4. The sheet operative member according to claim 1, wherein the sheet operative member is a conveyance roller contacting to the sheet for conveying the sheet by rotation thereof.

5. The sheet operative member according to claim 1, wherein the sheet operative member is a separation pad for contacting the sheet being conveyed and separating one of the sheets out of the plural sheets.

6. A sheet conveying apparatus for conveying a sheet, comprising: a conveyance roller for contacting the sheet and conveying the sheet by rotation thereof, the conveyance roller having a plurality of protrusions on an operative surface with the sheet; and each of the protrusions including:

a standing portion standing up from the operative surface; and a spherical portion disposed at a distal end of the standing portion.

7. A sheet conveying apparatus for conveying a sheet separately one by one out of a plurality of sheets, comprising:

a conveyance member for applying conveyance force to a sheet; and a separation pad for contacting the sheet being conveyed and separating one of the sheets out of the plural sheets, the separation pad having a plurality of protrusions on an operative surface with the sheet; and each of the protrusions including:

a standing portion standing up from the operative surface; and a spherical portion disposed at a distal end of the standing portion.

8. An image processing apparatus for forming an image on a sheet, comprising:

an image forming means for forming the image;

a sheet conveying apparatus for feeding the sheet to the image forming means, the sheet conveying apparatus including a sheet operative member contacting the sheet and conveying with frictional force the sheet or separating the sheet, the sheet operative member including:

a plurality of protrusions on an operative surface with the sheet; and each of the protrusions including:

a standing portion standing up from the operative surface; and a spherical portion disposed at a distal end of the standing portion.

9. The image processing apparatus according to claim 8, wherein the sheet operative member is a conveyance roller for contacting the sheet and conveying the sheet by rotation thereof.

10. The image processing apparatus according to claim 8, wherein the sheet operative member is a separation pad for contacting the sheet being conveyed and separating one of the sheets out of the plural sheets.

11. An image processing apparatus comprising:

an image reading means for reading an image on an original document sheet; and a sheet conveying apparatus for feeding the original document sheet to the image forming means, the sheet conveying apparatus including a sheet operative member contacting the original document sheet and conveying with frictional force the original document sheet or separating the original document sheet, the sheet operative member including:

a plurality of protrusions on an operative surface with the original document sheet; and each of the protrusions including:

a standing portion standing up from the operative surface; and a spherical portion disposed at a distal end of the standing portion.

12. The image processing apparatus according to claim 11, wherein the sheet operative member is a conveyance roller for contacting the original document sheet and conveying the original document sheet by rotation thereof.

13. The image processing apparatus according to claim 11, wherein the sheet operative member is a separation pad for contacting the original document sheet being conveyed and separating one of the original document sheets out of the plural original document sheets.

* * * * *

UNITED STATES PATENT AND TRADEMARK OFFICE

CERTIFICATE OF CORRECTION

PATENT NO. : 6,735,413 B2
DATED : May 11, 2004
INVENTOR(S) : Akira Yuza et al.

It is certified that error appears in the above-identified patent and that said Letters Patent is hereby corrected as shown below:

Column 3,
Line 9, “according” should read -- according to --.
Line 35, “a” should read -- an --.

Signed and Sealed this

Seventeenth Day of August, 2004

JON W. DUDAS
*Acting Director of the United States Patent and Trademark Office*